United States Patent [19]

Smith, Jr.

[11] 4,188,757

[45] Feb. 19, 1980

[54] TELESCOPING AERIAL LIFT

[76] Inventor: Raymond E. Smith, Jr., 385 E. Greenwood, Lake Forest, Ill. 60045

[21] Appl. No.: 839,721

[22] Filed: Oct. 5, 1977

Related U.S. Application Data

[63] Continuation-in-part of Ser. No. 758,810, Jan. 12, 1977, Pat. No. 4,070,807.

[51] Int. Cl.[2] ..... B66C 23/00; E04G 1/22

[52] U.S. Cl. ..... 52/111; 52/119; 182/2; 182/63

[58] Field of Search ..... 52/111, 115, 116, 117, 52/118, 119; 182/2, 63, 127, 141

[56] References Cited

U.S. PATENT DOCUMENTS

| | | | |
|---|---|---|---|
| Re. 23466 | 3/1952 | McElhinney et al. . | |
| 2,598,685 | 6/1952 | Greenlief . | |
| 4,070,807 | 1/1978 | Smith | 52/119 |

FOREIGN PATENT DOCUMENTS

| | | |
|---|---|---|
| 444147 | 5/1925 | Fed. Rep. of Germany . |
| 2091898 | 1/1972 | France . |
| 210258 | 9/1940 | Switzerland . |
| 948395 | 2/1964 | United Kingdom . |

*Primary Examiner*—John E. Murtagh

*Attorney, Agent, or Firm*—Cook, Wetzel & Egan, Ltd.

[57] ABSTRACT

An aerial lift is described which has a pivotable boom with a load end and a pivot end. The boom is constructed such that, as the pivot end of the boom pivots upwardly, the load end is raised substantially vertically. In one embodiment, the boom is mounted on a telescoping scaffold to provide the boom with a greater reaching range. In another embodiment, the boom itself is provided with telescoping members to extend its vertical reach.

13 Claims, 11 Drawing Figures

TELESCOPING AERIAL LIFT

CROSS REFERENCE TO RELATED APPLICATION

This application is a continuation-in-part of my co-pending application Ser. No. 758,810, filed Jan. 12, 1977, now U.S. Pat. No. 4,070,807.

BACKGROUND OF THE INVENTION

This invention relates generally to aerial lifts and more particularly to an aerial lift which has a pivotable boom.

In building construction and maintenance, mining, storage/retrieval operations and many other fields, it is often necessary to provide aerial lifts for moving equipment and/or personnel. These lifts have generally been of two types; i.e., cranes and adjustable scaffolds. Conventional cranes are capable of lifting very large loads to relatively great heights. These cranes are usually vehicular to facilitate movement to the job site. When actual lifting is performed, however, the base of the crane, or the vehicle on which it is mounted, is ordinarily fixed in position by stabilizing pads. Since most cranes consist essentially of pivotable booms, this results in the pivot point being fixed. Thus, unless the boom is extensible, as the position of the boom is varied, the load end of the boom moves in an arc. If a load is suspended from the boom, this action will cause the load to swing toward the boom pivot end and, more importantly, toward the boom operator, thus increasing the safety hazards inherent in such operations. If the crane is being utilized to elevate workmen and/or equipment along a vertical plane, the load end necessarily moves increasingly further from said plane as the boom angle increases.

These disadvantages are often overcome by providing extensible, ordinarily telescoping, boom sections. These boom sections are ordinarily extended by power cylinders which extend to force the telescoping boom section outward. Thus, as the boom angle is increased, the power cylinder is extended by the operator thus increasing the length of the boom. This insures that the boom load end moves in a substantially vertical line. This extensible power cylinder dramatically increases the cost of such units. Also, to insure proper, safe operation, a highly skilled operator is required. The operator must pay close attention to retain the load in the original vertical plane. Even with a highly skilled, attentive operator this is often a very difficult procedure since the operator's line of sight is often inadequate to provide accurate adjustments. Due to the line-of-sight problem a second operator is often placed in closer proximity to the load end. This not only increases the cost of operating the crane, but also increases safety hazards since the possibility of mis-understanding between operators is ever present. While boom mechanism may be automated to retain the load in the same vertical plane, such automation systems are quite expensive.

Adjustable scaffolds are often utilized to move loads along a vertical plane. Scissors-type scaffolds, such as that described in my co-pending application, Ser. No. 738,599, filed Nov. 3 1976, have been found to be advantageous. However, since such apparatuses do not provide a capability of lateral movement, they are limited in their scope of operation. If a simple, nonextensible crane were mounted on an adjustable scaffold, the reaching coverage of the apparatus is still limited, as discussed further hereinbelow and illustrated in the drawings.

Accordingly, one object of the present invention is the provision of a crane which need not have an extensible power cylinder for lengthening the boom but which can move a load in a substantially vertical plane. Another object is provision of a crane which can be easily automated. Yet another object is provision of an aerial lift which is simpler than present lifts but which has greater versatility and lifting range. These and other objects, features, and advantages of the present invention will be apparent from the following description, appended claims, and annexed drawings.

SUMMARY OF THE INVENTION

According to one aspect of this invention there is provided an aerial lift having an extensible boom whose pivot end moves in a horizontal direction as its load end is raised and lowered, to provide a crane which can move a load along a substantially vertical line without the necessity of including an additional power cylinder to extend the boom. A pivotable boom having a load end and a pivot end is mounted to a supporting means so that the boom pivot end is horizontally movable but vertically fixed. A support arm extends between the supporting means and a median point of the boom, and is pivotally mounted to each so that as the boom is pivoted, the load end is extended upwardly and outwardly to raise the load end substantially vertically. Finally, drive means for raising and lowering the boom is provided.

The novel features which are believed to be characteristic of the invention are set forth in the appended claims. It is believed the invention will be best understood by reference to the following description taken in connection with the accompanying drawings.

DETAILED DESCRIPTION OF THE PREFERRED EMBODIMENTS

Figure 1:
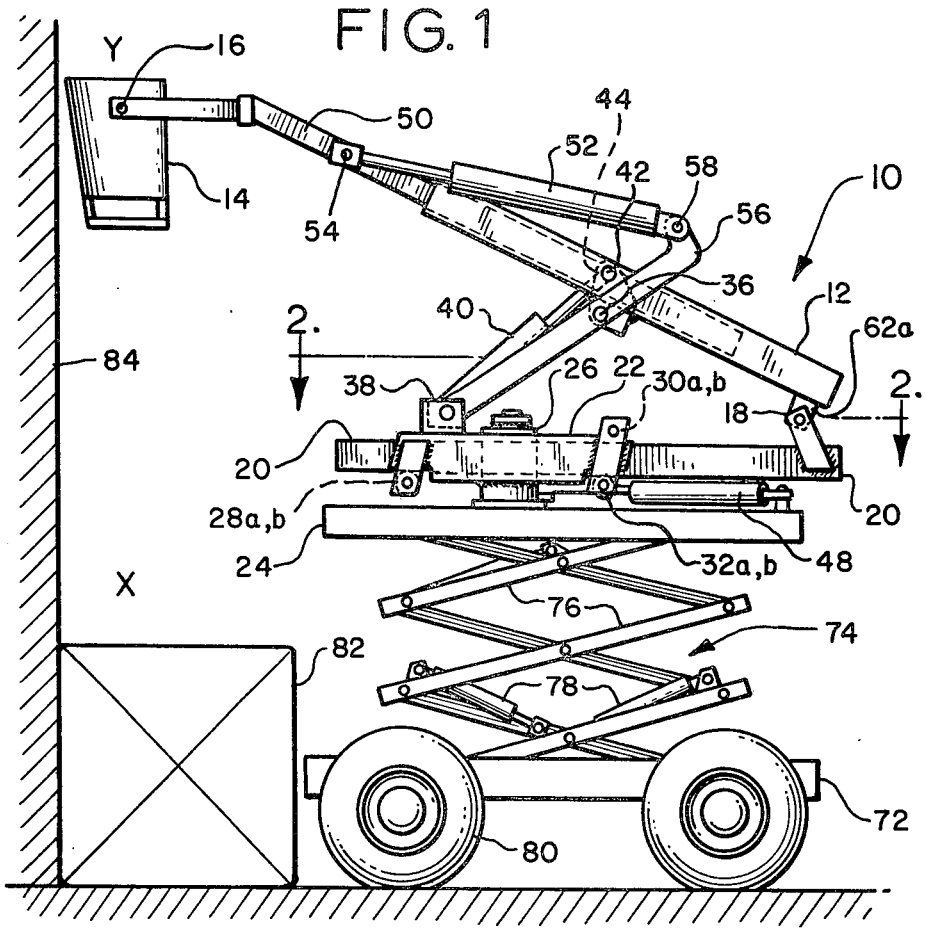
FIG. 1 is an elevation view of the invention in an intermediate position.

In that form of the invention depicted in the drawings, the aerial lift is indicated generally at 10. A pivotable boom 12 is shown to support a basket 14 which may be designed to carry a load. This load may include workmen but may alternatively or additionally include machinery of any conceivable type. In the depicted embodiment the basket 14 is allowed to rotate on pins 16 to maintain its upright position. The load end of the boom may include conventional lifting forks and automated or manual leveling mechanisms of conventional design to maintain the forks parallel to the ground. If the load is designed to be suspended from the boom, of course, no such leveling mechanism is required.

Figure 3:
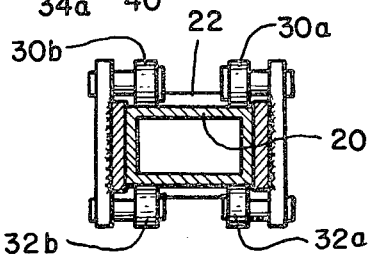
FIG. 3 is a sectional view taken along line 3—3 of FIG. 2.

The pivot end of the boom 12 is pivotally mounted at joint 18 to a sliding beam 20 which is slidably mounted in a channel which may alternatively be described either as being mounted to a mounting table 24, or as being a part of said mounting table. The channel 22 is rotatably mounted to the mounting table, or the remainder of the table, on a substantially vertical cylinder 26, to be described in more detail hereinbelow. The function of the channel 22 is to prevent axial displacement of the beam 20 with respect to the mounting table 24. Ordinarily both the beam 20 and the table 24 will be substantially horizontal as depicted, but this is not necessary for the proper operation of the apparatus. Rollers 28*a* and *b*, 30*a* and *b*, and 32*a* and *b* are provided as depicted in FIG. 3 to insure that the beam 20 is slidable within the channel 22. Since a downward loading of the boom load end will tend to force clockwise axial displacement of the beam 20 with respect to cylinder 26, rollers 28*a* and *b*, and 32*a* and *b* will ordinarily carry most of the load.

The boom 12 is also pivotably mounted to support arms 34*a* and *b* at point 36. These support arms 34*a* and *b* in turn are pivotally mounted to the channel 22 at joint 38. Thus, as the boom 12 is raised and lowered, the boom, beam, and support arm structure will pivot on joints 18, 36, and 38 to cause the beam to reciprocate with respect to the channel 22 and the mounting table 24.

Drive means for raising and lowering the boom 12 ordinarily comprises a hydraulic pivot cylinder 40 having one end pivotally mounted to the channel at a point no closer to the boom pivot end than the support arm joint 38, and the other end pivotally mounted to the boom 12 at a point remote from the support arm boom joint 36. The term "remote from" means only that the joints may not be coaxial. As depicted in the Figures, this pivot cylinder joint 42 is mounted to the boom 12 via plate 44 which is rigidly secured to the boom and which lies closer to the boom load end than does support arm joint 36. Also as depicted in the Figures, the other end of the pivot cylinder 40 is pivotally connected to the channel 22 at joint 38, coaxial with the point at which the support arm is mounted to the channel. This joint 38 will be further described hereinbelow.

While the above-described means of driving the lift is the preferred design, other means (not depicted) may alternately be utilized. For example, sliding beam 20 and rollers 18*a* and *b*, 30*a* and *b*, and 32*a* and *b* may act as a rack and pinion so that rotation of the rollers in either direction will change the lateral position of the beam 20, thus causing a change in the vertical position of the beam load end.

Figure 2:
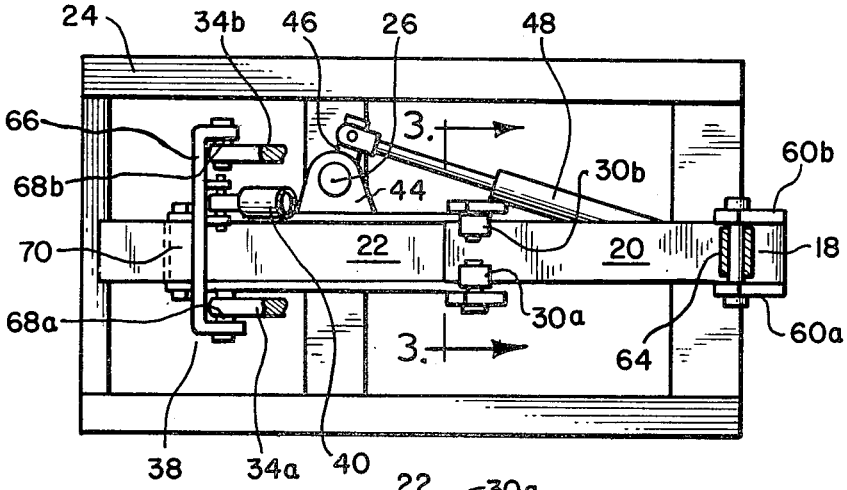
FIG. 2 is a sectional view taken along line 2—2 of FIG. 1.

As stated hereinabove, the channel 22 is rotatable with respect to the mounting table 24. This feature obviously increases the versatility of the lift to a substantial degree. The channel is rotatable on the vertical cylinder 26 which, as depicted in FIG. 2, is offset from the channel 22 and the remainder of the boom apparatus. The channel 22 is mounted on the vertical cylinder 26 by the member 44 which extends from the channel 22 and surrounds the vertical cylinder 26. Extending from member 44 is a leg 46 to which is pivotally mounted the rotational drive means, here a conventional hydraulic cylinder 48. The opposite end of this cylinder 48 is pivotally mounted to the mounting table 24.

One of the advantages of the present invention is that it allows a load to be elevated along a path which is much closer to a vertical line than do conventional booms which, when inextensible, swing the load in an arc. To provide a crane which can elevate a load along a line which is even closer to vertical, a telescoping section 50 can be added to the apparatus along with a telescoping cylinder 52. As shown, one end of the telescoping cylinder 52 is pivotally connected to a support arm extension 56 at joint 58. The telescoping cylinder itself need not be extensible, i.e., it may be rigid. As the boom is adjusted to various levels of inclination, the movement of the support arm extension causes the telescoping cylinder to automatically extend and retract the telescoping section of the boom. As shown in the Figures, however, the telescoping cylinder 52 ordinarily is a conventional extensible hydraulic cylinder. This provides a crane with even greater versatility.

As indicated in the Figures, the slidable beam 20 is ordinarily of rectangular configuration. The pivotable boom 12 and its telescoping section 50 are preferably also rectangular in cross section. Thus, the rollers 18*a* and *b*, 30*a* and *b*, and 32*a* and *b* are mounted on opposite sides of the slidable beam 20. Similarly, joints 18 and 36 extend across the entire cross section of the boom. Beam legs 60*a* and 60*b* extend from each side of the end portion of the beam to meet legs 62*a* and 62*b* (not visible) at pivot joint 18. A suitable bearing 64 is provided.

As shown in FIG. 2 the support arms 34*a* and *b* extend between joints 36 and 38, one on each side of the boom 12. The support arm extension 56 is ordinarily an extension of one of these arms since the telescoping cylinder 52 extends from joint 58 to only one side of the telescoping section 50 at joint 58.

As mentioned hereinabove and shown in FIG. 2, the points at which the support arms 34 and the pivot cylinder 40 are mounted to the channel 22 are preferably coaxial at joint 38. A joint plate 66 is fixed to the top of the channel and extends across the entire cross section of the slidable beam 20. This point 38 is actually comprised of three separate joints, with the support arms 34*a* and *b* pivotable on pins 68*a* and *b*, respectively. The pivot cylinder pivots on pin 70.

The mounting table 24 to which the above-described apparatus is mounted is preferably vertically adjustable above a base 72. The means for raising and lowering the table 24 may be of scissors design, such as that described in my co-pending application Ser. No. 738,599, filed Nov. 3, 1976 now U.S. Pat. No. 4,088,203. This scissors mechanism shown generally at 74 includes scissors arms 76 and power cylinders 78. The base 72 is preferably provided with wheels 80 to insure mobility. Brakes (not shown) would also be desirable.

The scissors mechanism 74 may also be of the telescoping type for greater lift, as described in my co-pending application Ser. No. 782,183, filed Mar. 28, 1977 now U.S. Pat. No. 4,130,178.

Figure 4:
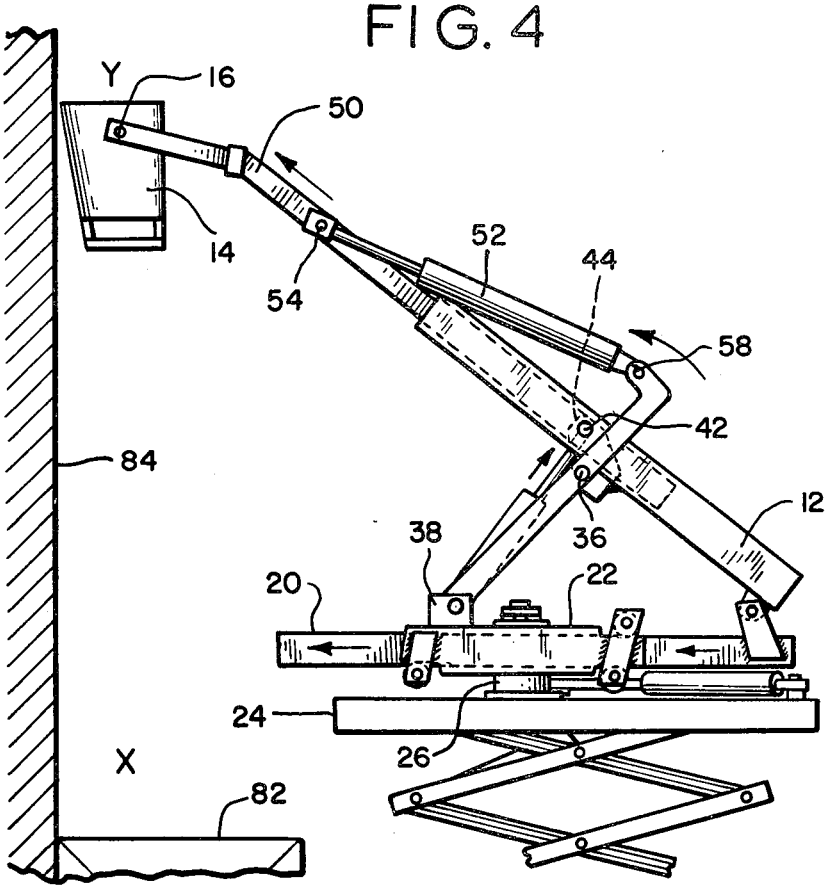
FIG. 4 is an elevation view of the invention in the fully elevated position.
Figure 5:
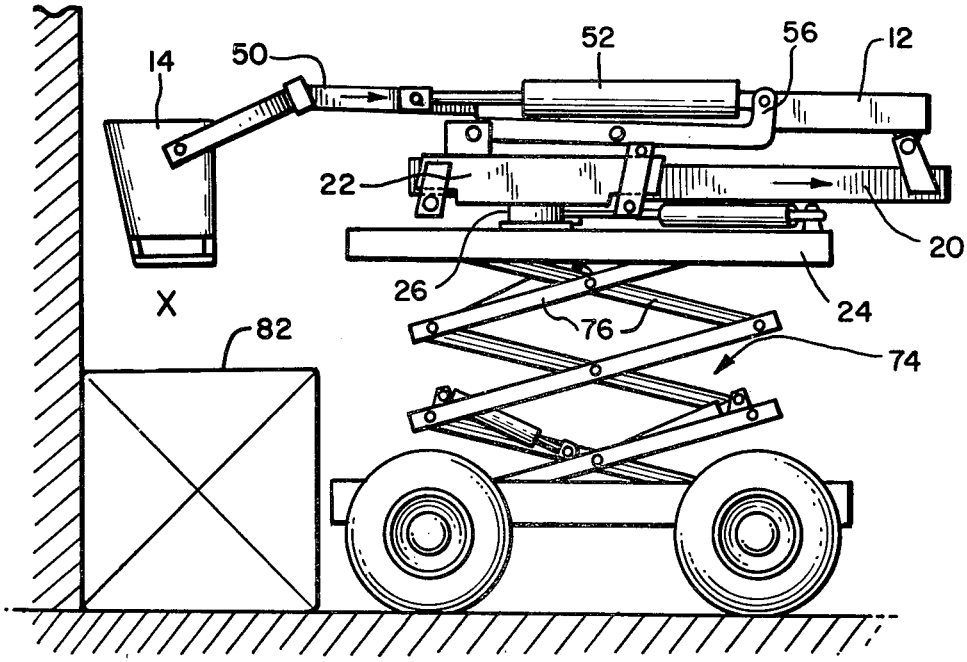
FIG. 5 is an elevation view of the invention in the fully lowered position.

In operation the above-described scissors mechanism co-operates with the pivotable boom apparatus to provide an aerial lift with greater reaching range. FIGS. 4 and 5 show the boom in lowered and raised positions, respectively, and FIG. 1 shows it in an intermediate position. A box 82 is included in these Figures to show that the aerial lift provides a reaching capability to all portions of the wall 84 with which the box 82 abuts. If the boom apparatus alone was mounted adjacent the wheels 80, the area indicated generally at X would be unreachable. Assuming the box 82 was substantially lower and the scissors mechanism 74 was fully collapsed, a conventional non-extensible boom would be unable to reach both area X and the area indicated at Y since the boom load end would necessarily move in an arc.

With the boom in the fully lowered position of FIG. 5 the pivot cylinder 40 is fully retracted and the slidable beam 20 is fully extended from the channel 22. The basket 14 is in its lowest position, nearly abutting the wall 84. To elevate the boom 12 the operator starts to extend the pivot cylinder 40, resulting in a rotational movement between joints 42 and 36. This causes joint 36 to swing upward and to the left, and the beam 20 to retract into the channel 22. The movement of the support arm extension 56 toward the boom load end causes the telescoping cylinder 52 to extend the telescoping section 50 of the boom 12, thus causing the basket 14 to elevate and remain in close proximity to the wall 84. To reach the position shown in FIG. 4, the pivot cylinder is fully extended, causing the beam 20 to fully retract through the channel 22, and causing joint 36 to swing to its uppermost position. At the same time telescoping section 50 has become fully fixed extended. To lower the apparatus, the pivot cylinder 40 is retracted and the process is repeated. If lateral movement of the basket is desired, the boom telescoping section 50 can be further extended or retracted by activating the telescoping cylinder 52. For axial translation the rotation drive cylinder 48 is utilized. To rotate the boom apparatus in a clockwise direction with reference to FIG. 3, the rotation drive cylinder 48 is retracted and for counterclockwise rotation the cylinder is extended.

Figure 6:
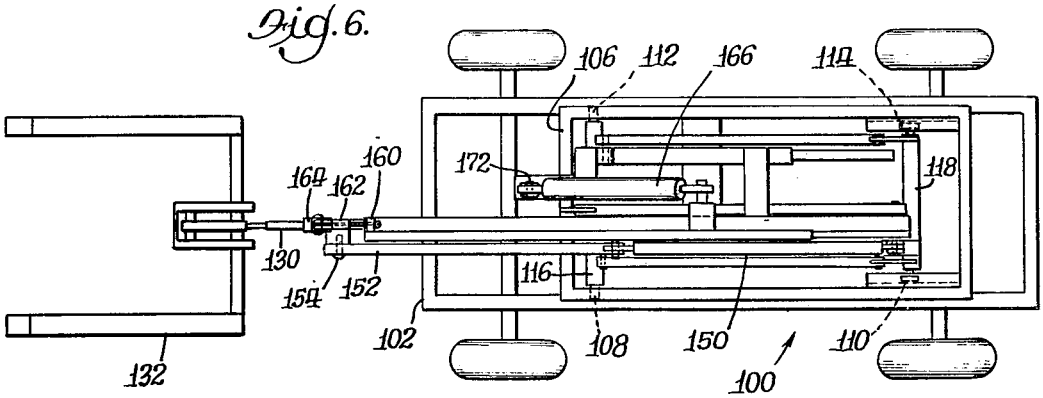
FIGS. 6 and 7 show top and side elevation views, respectively, of another embodiment of the invention, shown in a lowered position.

Referring now to FIGS. 6–10, there is shown an alternate embodiment 100 of the previously described aerial lift. The alternate aerial lift 100 employs the same principles of boom extension as described previously and additionally achieves greater elevational height. As shown in FIGS. 6 (top view) and 7 (side view) the aerial lift 100 is mounted on a wheeled supporting frame 102. Rotational movement of the lift 100 is provided by a swivel cylinder 104 which may be powered by conventional means (not shown) for rotating the lift with respect to the frame 102.

Mounted atop the cylinder 104 is a platform 106 for pivotally supporting the upper structure of the lift 100. Connection between the platform 106 and the upper structure of the lift 100 is made at pivot points 108, 110, 112, and 114 (best seen in FIG. 6) to which a pair of pivotable rods 116 and 118 are connected. As explained in more detail hereinafter, the rods 116 and 118 rotate about their longitudinal axis as the lift is raised. In addition, the rod 118 moves horizontally within a channel 120 (FIG. 2) as the lift 100 moves vertically.

Figure 8:
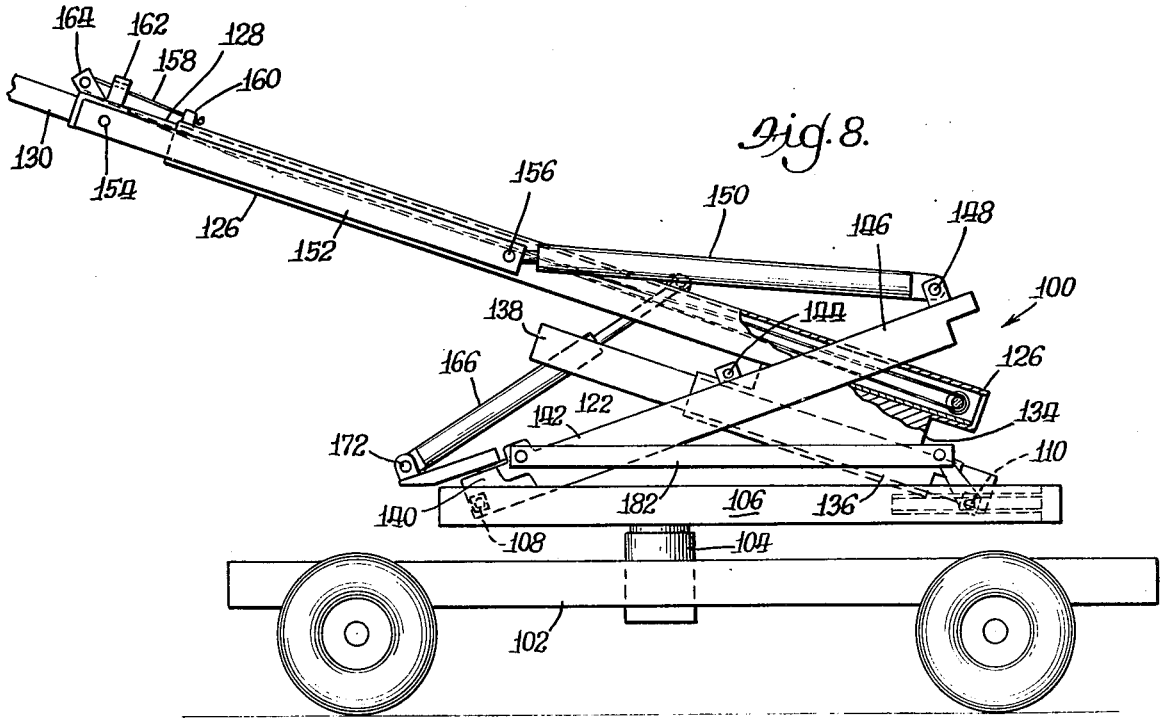
FIG. 8 is a side elevational view of the embodiment of FIGS. 6 and 7, shown in a partially extended position.
Figure 10:
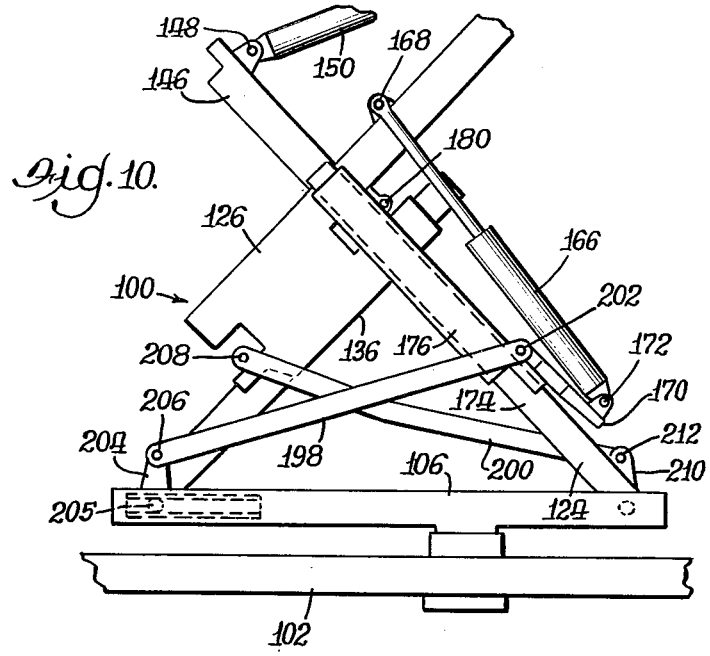
FIG. 10 is a fragmentary side view showing a portion of the side of the embodiment not visible in FIG. 9.
Figure 9:
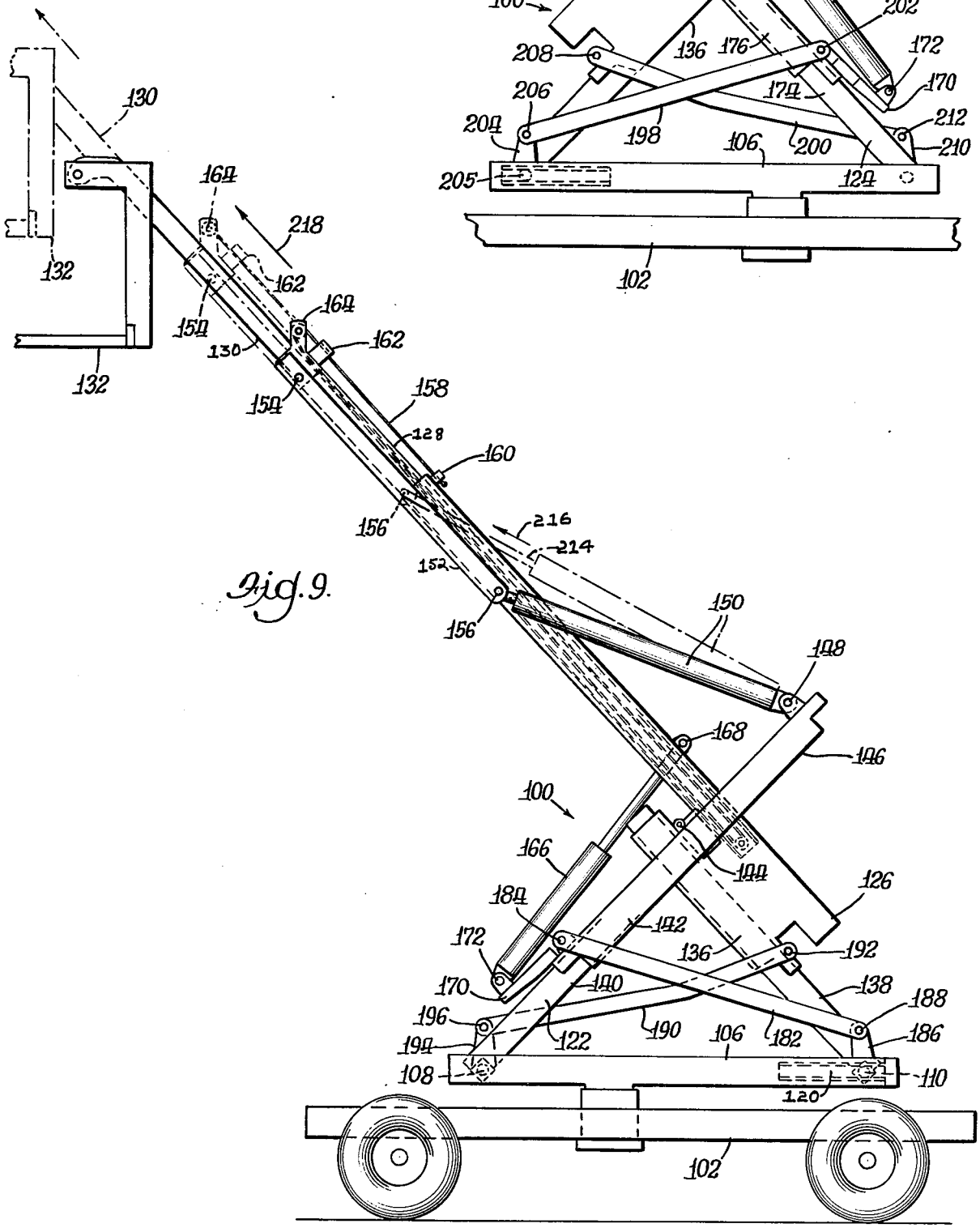
FIG. 9 is a side view of the embodiment of FIG. 8, shown in a more fully extended position.

Rigidly connected to the rod 116 is a pair of support arms 122 and 124, the latter of which is shown in FIG. 10 which illustrates a portion of the reverse side of the lift 100. Thus, as the rod 116 pivots about its longitudinal axis, the support arms 122 and 124 will pivot upwardly as shown in FIGS. 8, 9 and 10.

Rigidly connected to the rod 118 is a three piece extensible boom comprising a pivot end 126, an intermediate section 128, and an upper section 130, from the latter of which a load, shown in the form of a fork lift 132, extends. The intermediate boom section 128 telescopes within the pivot end 126 and the upper boom section 130 telescopes within the intermediate section 128 as best shown in FIG. 8. To pivot the section 126 during elevation of the lift 100, the pivot end 126 includes a rigidly connected offset portion 134 coupled to a boom sleeve 136. The sleeve 136 slides on a boom shaft 138 which is rigidly connected to the rod 118 via the sleeve 136 and the shaft 138 permits the lift 100 to be elevated to a relatively great height without the use of an additional scissors-type scaffold. In effect, a small scissors-type scaffold is built into the lift 100.

Referring now to the support arm 122 (FIGS. 8 and 9), it includes a support arm shaft 140 upon which a support arm sleeve 142 rides in a telescoping manner. The support arm sleeve 142 is pivotally coupled to the boom sleeve 136 at 144.

Extending beyond the boom and the pivot 144 is a support arm extension 146 which, in this embodiment, is an integral extension of the support arm sleeve 142. Pivotally coupled to the support arm extension 146 at 148 is a rigid linkage which preferably includes a telescoping cylinder 150 and a bar 152. One end of the bar 152 is fixed to the intermediate boom section 128 at 154 and the other end thereof is pivotally connected to the cylinder 150 at 156. This connection between the intermediate boom section 128 and the support arm extension 146 causes the intermediate boom section 128 to telescope or extend out of the pivot section 126 at the lift 100 is elevated.

To extend the upper boom section 130, a cable 158 (FIGS. 8 and 9) is run from a connection 160 on the pivot boom end 126, through a cable guide 162, around a sheave 164 mounted on the intermediate boom section 128, back down through the intermediate boom section 128, and connected to the bottom of the upper boom section 130. The connection of the cable 158 is conventional and is, therefore, not shown in detail. Suffice it to say that the cable 158 pulls the upper boom section 130 out of the intermediate boom section 128 as the latter is extended.

The means by which the lift 100 is elevated is shown most clearly in FIGS. 9 and 10 to which reference is now made. As shown, one end of a telescoping cylinder 166 is pivotally connected to the boom pivot end 126 at 168. The other end of the cylinder 166 is pivotally connected to a bracket 170 at 172. The bracket 170, in turn, is connected to the support arm 124 (FIG. 10). As with the support arm 122, the support arm 124 also includes a support arm shaft 174 telescoped within a support arm sleeve 176. The shaft 174 is mounted on the rod 116 (FIG. 6) for rotation therewith as the lift 100 rises. The sleeve 176 is pivotally coupled to the boom pivot end 126 at 180.

As described above, the boom pivot end 126 and the support arms 122 and 124 each include a shaft and a sleeve in telescoping relation. To extend the various sleeves upwardly from their respective shafts, a set of link arms which pull the sleeves upwardly about the shafts are included. More specifically, and as shown in FIG. 9, a link arm 182 is pivotally coupled at one end to the support arm sleeve 142 at 184 and at its other end to a bracket 186 at 188. The bracket 188, in turn, is mounted on the rod 118 for rotation therewith.

Another link arm 190 is pivotally coupled at 192 to the boom sleeve 136 and at its other end to a bracket 194 at 196. The bracket 194, in turn, is mounted on the rod 116 for rotation therewith.

Referring to FIG. 10, there is shown a pair of link arms 198 and 200 for raising the support arm sleeve 176 and the boom sleeve 136, respectively. Specifically, the link arm 198 is pivotally coupled at one end to the support arm sleeve 176 at 202 and at its other end to a bracket 204 at 206. The bracket 204 is mounted on the rod 118 for rotation therewith. As shown, the rod 118 engages a channel 205 for rotation and horizontal movement therein. The link arm 200 is pivotally coupled at one end to the boom sleeve 136 at 208 and at its other end to a bracket 210 at 212. The bracket 210 is mounted on the rod 116 for rotation therewith.

In operation, the raising of the lift 100 is initiated by actuation of the cylinder 166. This raises the boom pivot end 126 and the support arms 122 (FIG. 9) and 124 (FIG. 10). Simultaneously, the rods 116 and 118 (FIG. 6) begin to rotate about their longitudinal axes, thereby also rotating the brackets 186 and 194 (FIG. 9) and the brackets 204 and 210 (FIG. 10). As the brackets 186 and 194 rotate, they cause the link arms 182 and 190 to telescope the support arm sleeve 142 and the boom sleeve 136 upwardly. Concurrently, the rotation of the brackets 204 and 210 causes the link arms 198 and 200 (FIG. 10) to telescope the boom sleeve 136 and the support arm sleeve 176 upwardly. As a result of the simultaneous extension of the boom sleeve 136 and the support arm sleeves 142 and 176, the point 144 (connecting the support arms to the boom pivot end 126) rises substantially vertically.

As the support arm sleeve 142 extends, the connection 148 between the cylinder 150 and the support arm extension 146 moves upwardly and to the left in FIG. 9. This motion is translated to the intermediate boom section 128 via the cylinder 150 (unextended) and the bar 152. As a result, the intermediate boom section 128 is extended out of the boom pivot end 126 such that the upper end of the intermediate boom section 126 rises substantially vertically.

The extension of the intermediate boom section 128 results in the upper boom section 130 being simultaneously extended by the cable 158, thereby raising the fork lift 132 substantially vertically.

Figure 7:
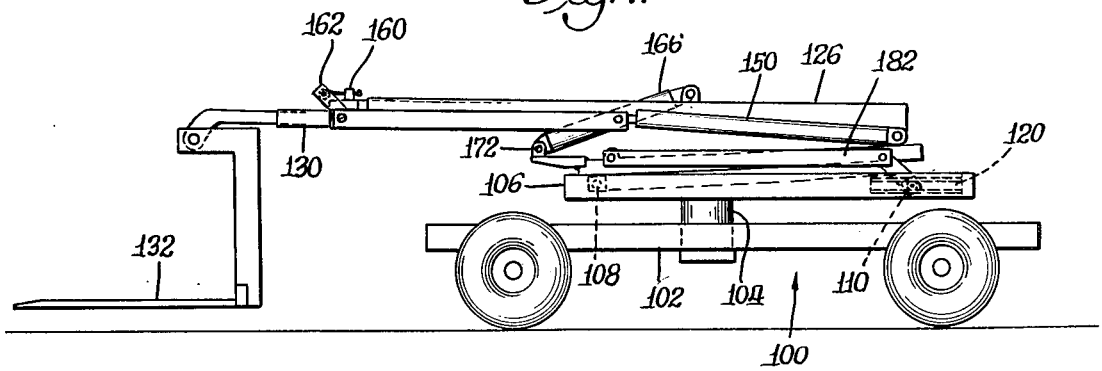

During the raising of the lift 100, the point 110 on the rod 118 moves from its initial position shown in FIG. 7 to the right as shown in FIG. 9. This motion occurs as the lift 100 extends somewhat more than half its maximum elevation. When the cylinder 166 is actuated to raise the lift further, the point 110 moves to the left until it reaches approximately its original position. At this point, the lift 100 will have been raised to its fullest elevation which is greater than that shown in FIG. 9.

Up until now, the operation of the lift 100 has been described with the cylinder 150 acting merely to translate the motion of the support arm extension 146 to the bar 152 and thence to the intermediate boom section 128. However, if greater extension of the intermediate boom section 128 is desired, the cylinder 150 is actuated. As shown in the dashed lines of FIG. 9, the actuation of the cylinder 150 drives a cylinder rod 214 in the direction of the arrow 216. As a result, the intermediate boom section 128 is further extended in the direction of the arrow 218. The distance between the solid line sheave 164 and the dashed line sheave 164 indicates the increased extension of the intermediate boom section 128 resulting from the actuation of the cylinder 150. In addition, because the intermediate boom section 128 and the upper boom section 130 are joined by the cable 158, this further extension of the intermediate boom section 128 also results in further extension of the upper boom section 130.

As illustrated in FIG. 9, the cylinder 150 may be actuated prior to full extension of the cylinder 166 and operates to independently extend the intermediate and upper boom sections 128 and 130.

When the cylinder 166 is deactuated, the lift 100 folds from the extension shown in FIG. 9 to that of FIG. 8, and finally to the folded position shown in FIG. 7. Thus, a very compact but high reaching lift is provided by the illustrated structure.

In the description above, it has been mentioned that the cylinder 150 and the bar 152 rigidly couple the support arm extension 146 to the intermediate boom section 128. Obviously, these components have a number of pivot points and the cylinder 150 may be extended and retracted as required. A rigid coupling is, therefore, meant to include any linkage which translates the pivoting motion of the support arm extension 146 to a sliding motion of the intermediate boom section 128.

Figure 11:
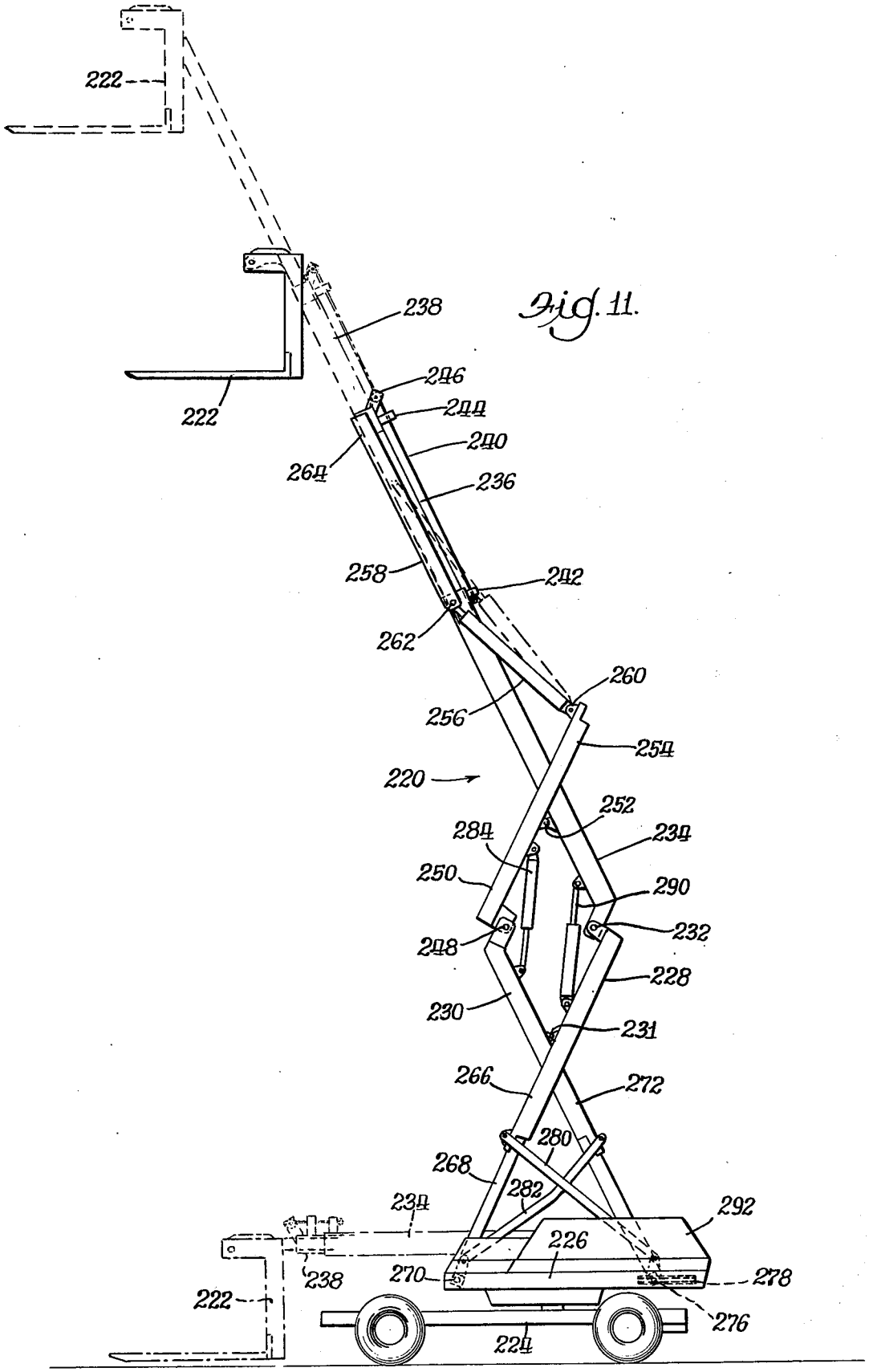
FIG. 11 is a side view of yet another embodiment of the invention, shown in an extended position.

Referring now to FIG. 11, there is shown another embodiment of the invention which extends a boom in accordance with the principles set forth above but which achieves even greater height. The aerial lift 220 of FIG. 11 is shown in an extended position in which a fork lift 222 is elevated, and also in its folded position at the bottom of FIG. 11.

The lift 220 may be mounted on a wheeled platform 224 as shown, above which a supporting base 226 is mounted. The base 226 supports a pair of scissors members 228 and 230, preferably of the telescoping variety as shown, and pivotally coupled at 231.

Pivotally mounted to the scissors member 228 at 232 is a boom pivot end 234. The pivot end 234 receives within it, in telescoping relation, an intermediate boom section 236 and an upper boom section 238 telescopes within the intermediate section 236. The fork lift 222 is mounted at the upper end of the upper boom section 238. As in the previously described embodiment, the upper boom section 238 is caused to extend out of the intermediate section 236 by a cable 240 whenever the intermediate section 236 extends. As shown, one end of the cable 240 is fixed to the boom pivot end 234 at 242 and the other end passes through a cable guide 244, through a sheave 246, and is attached in a conventional manner (not shown) to the bottom of the upper boom section 238.

Pivotally connected to the scissors member 230 at 248 is a support arm 250 for extending the intermediate boom section 236. The support arm 250 is pivotally coupled to the boom pivot end 234 at 252 and extends beyond the pivot end 234 as a support arm extenstion 254. When the lift 220 is elevated, the support arm 250 pivots about the point 248 and the extension 254 moves upwardly and to the left in FIG. 11. The pivoting motion of the support arm 250 is translated to a sliding or telescoping motion of the intermediate boom section 236 by means of a rigid coupling which, as shown, is preferably an extendable cylinder 256 and a bar 258. One end of the cylinder 256 is pivotally coupled at 260 to the support arm extension 254 and the other end thereof is pivotally coupled to the bar 258 at 262. The bar 262, in turn, is connected to the intermediate boom section 236 at 264.

Referring now to the scissors members 228, it preferably comprises a sleeve 266 in telescoping relation with a shaft 268, the latter of which is mounted on a rotatable rod 270. The rod 270 extends in a plane perpendicular to the plane of FIG. 11 and has its ends mounted for rotation in the supporting base 226, similarly to the rod 116 of FIG. 6.

The scissors member 230 is similar to the scissors member 228 in that member 230 also comprises a sleeve 272 in telescoping relation with a shaft 274. The latter is mounted on a rod 276 which extends in a plane perpendicular to the plane of FIG. 11, similarly to the rod 118 of FIG. 6. One end of the rod 276 is mounted for rotation and horizontal sliding motion in a channel 278 in the supporting base 226. The other end of the rod 276 is mounted for rotation and sliding horizontal motion in a channel (not shown) on the opposite side of the supporting base 226.

To telescope the scissors members 228 and 230, a pair of link bars 280 and 282 couple the sleeves 266 and 272 to the rods 270 and 276. The ends of the link bars 280 and 282 may be mounted on the rods 270 and 278 in a manner similar to that of the bars 182 and 190 of FIG. 9.

Although not shown in the view of FIG. 11, another scissors member may be included paralleling the member 228 but on the opposite side of the scissors member 230. This additional scissors member would preferably have a shaft section mounted on the rod 270 and a sleeve section pivotally coupled at 232 to the boom pivot end 234. An example of such construction is illustrated in FIG. 2 of my copending application Serial No. 782,183, the teachings of which are incorporated herein.

In order to elevate the lift 220, a pair of extendable cylinders 284 and 286 may be connected as shown, the cylinder 284 being pivotally connected between the support arm 250 and the scissors 230, and the cylinder 286 being pivotally coupled between the boom pivot end 234 and the scissors 228. Upon the actuation of these cylinders, their cylinder rods 288 and 290 extend as shown, whereupon the scissors members 228 and 230 pivot about the longitudinal axes of the rods 270 and 276. In response to such pivoting, the link arms 280 and 282 extend the sleeves 266 and 272 upwardly. Simultaneously, the boom pivot end 234 is raised and the support arm 250 pivots about the point 248 to swing the support arm extension 254 upwardly and to the left. The cylinder 256 and the bar 258 then urge the intermediate boom section 236 upwardly to extend out of the boom pivot end 234. Simultaneously, the upper boom section 238 is extended out of the intermediate section 236, as a result of which the fork lift 222 is raised substantially vertically.

To achieve even further extension of the intermediate and upper boom sections, the cylinder 256 may be extended as shown in the dashed lines. This extension of the cylinder 256 urges the bar 258 upwardly, whereupon the intermediate boom section 236 and the upper boom section 238 further extend the fork lift 222 as shown in the dashed lines.

When the cylinders 256, 284 and 286 are deactivated, the lift 220 folds compactly as shown at the bottom of FIG. 11. A housing 292 may be mounted on the base 226 as shown for enclosing a control mechanism for actuating the various cylinders.

Of course, it should be understood that various changes and modifications to the preferred embodiments described therein will be apparent to those skilled in the art. Such changes and modifications can be made without departing from the spirit and scope of the present invention and without diminishing its attendant advantages. It is, therefore, intended that such changes and modifications be covered by the following claims.

What is claimed is:

1. An aerial lift, comprising:

a supporting means;

a boom having an extensible load end, a lower section terminating in a pivot end, an intermediate section telescoping with the lower section, and an upper section telescoping with the intermediate section;

means for mounting said boom to said supporting means such that said pivot end is horizontally movable;

a support arm extending between and pivotally connected to said support means and said boom;

means rigidly coupling the support arm to the extensible end of the boom, said coupling means being coupled between the support arm and the intermediate section of the boom;

means for raising and lowering said boom such that, as said boom is raised, the pivot end of said boom moves substantially horizontally, said support arm pivots about said supporting means and said boom, and said means coupling said support arm to the extensible end of said boom causes said extensible portion to extend for raising the load end of the boom substantially vertically, and means for extending the upper section of the boom as the intermediate section is extended.

2. An aerial lift as set forth in claim 1 wherein said means rigidly coupling the support arm to the intermediate section of the boom includes an extension of said support arm extending beyond said boom, and a telescoping cylinder connected between said support arm extension and the intermediate section of the boom for further extending the extensible end of the boom independently of the pivoting of said support arm.

3. An aerial lift, comprising:

a supporting means;

a boom having an extensible load end and a pivot end;

means for mounting said boom to said supporting means such that said pivot end is horizontally movable;

a support arm extending between and pivotally connected to said support means and said boom;

means rigidly coupling said support arm to the extensible end of said boom; and means for raising and lowering said boom such that, as said boom is raised, the pivot end of said boom moves substantially horizontally, said support arm pivots about said supporting means and said boom, and said means coupling said support arm to the extensible end of said boom causes said extensible portion to extend for raising the load end of the boom substantially vertically, the boom pivot end and the support arm each including telescoping sections adapted to be simultaneously extended when the boom is raised to increase the height to which the boom can be elevated.

4. An aerial lift as set forth in claim 3 wherein the pivot end of the boom includes a boom shaft telescoped in a boom sleeve, wherein said support arm includes a support arm shaft telescoped in a support arm sleeve, and further including at least one link arm connecting the boom sleeve to the support arm shaft and at least one link arm connecting the boom shaft to the support arm sleeve such that, as said boom is elevated and said support arm pivots, the link arms telescope the boom sleeve and the support arm sleeve upwardly to further elevate the boom.

5. An aerial lift as set forth in claim 4 wherein said boom includes a lower section terminating in the pivot end, an intermediate section telescoping with the lower section, and an upper section telescoping with the intermediate section, wherein said means rigidly coupling said support arm to the extensible portion of the boom includes an extension of the support arm sleeve extending beyond the lower section of the boom and means connected between the support arm sleeve extension and the intermediate section of the boom for telescoping the intermediate section as the support arm pivots, and further including means for extending the upper section of the boom as the intermediate section is extended.

6. An aerial lift as set forth in claim 5 wherein said means for extending the upper section of the boom includes a cable assembly connected between the intermediate and upper boom sections for pulling the upper section upwardly as the intermediate section extends.

7. An aerial lift as set forth in claim 4 wherein said means rigidly coupling the support arm to the extensible end of the boom includes an extension of the support arm sleeve extending beyond said boom and means connected between the support arm sleeve extension and the extensible end of the boom.

8. An aerial lift as set forth in claim 7 wherein said means connected between the support arm sleeve extension and the extensible end of the boom includes an extensible cylinder for further extending the extensible end of the boom independently of the pivoting of said support arm.

9. An aerial lift as set forth in claim 4 wherein the boom includes a lower section terminating in the pivot end, an intermediate section telescoping with the lower section, and an upper section telescoping with the intermediate section, wherein said means rigidly coupling the support arm to the extensible end of the boom is coupled between the support arm and the intermediate section of the boom.

10. An aerial lift as set forth in claim 9 further including means for extending the upper section of the boom as the intermediate section is extended.

11. An aerial lift as set forth in claim 9 wherein said means rigidly coupling the support arm to the intermediate section of the boom includes an extension of said support arm sleeve extending beyond the lower section of said boom, and means connected between said support arm sleeve extension and the intermediate section of the boom for further extending the intermediate section of the boom indepedently of the pivoting of said support arm.

12. An aerial lift as set forth in claim 11 wherein said means for further extending the intermediate section of the boom includes an extensible cylinder.

13. An aerial lift as set forth in claim 3 further including means for rotating said boom about a substantially vertical axis.

* * * * *